US005485860A

United States Patent [19]

Robb et al.

[11] Patent Number: 5,485,860

[45] Date of Patent: Jan. 23, 1996

[54] SPRAY GUN AND ASSOCIATE PARTS WASHER AND RECYCLER

[75] Inventors: Richard A. Robb, West Bloomfield, Mich.; Michael J. Grubb, London, Canada; John J. Grubb, Calgary, Canada; James T. Asanger, Carstairs, Canada

[73] Assignee: Herkules Equiptment Corp., Walled Lake, Mich.

[21] Appl. No.: 952,644

[22] Filed: Sep. 28, 1992

Related U.S. Application Data

[62] Division of Ser. No. 362,611, Jun. 7, 1989, Pat. No. 5,174,317, which is a division of Ser. No. 288,466, Dec. 22, 1988, abandoned, which is a continuation of Ser. No. 904,097, Sep. 5, 1986, Pat. No. 4,793,369.

[51] Int. Cl.[6] ..... B08B 3/02

[52] U.S. Cl. ..... 134/166 C; 134/169 C; 134/170; 134/184

[58] Field of Search ..... 134/166 C, 169 C, 134/168 C, 170, 200, 166 R, 169 R, 171, 184

[56] References Cited

U.S. PATENT DOCUMENTS

| | | | |
|---|---|---|---|
| 2,786,000 | 3/1957 | Roach | 134/21 |
| 3,771,539 | 11/1973 | De Santis | 134/111 |
| 4,025,363 | 5/1977 | De Santis | 134/102 |
| 4,923,522 | 5/1990 | Sowers | 134/138 |

*Primary Examiner*—Frankie L. Stinson

[57] ABSTRACT

A system for cleaning paint from objects such as spray guns, associated cups and paint cans comprising: an enclosed housing divided into a work chamber and a fluid storage reservoir containing paint solvent and a fluid, having a specific gravity greater than that of the solvent; spray nozzles attached to a first and a second outlet adapted to receive and spray pressurized solvent therefrom; the first outlet includes a tube for receiving and supporting a spray gun and for directing solvent to flow through an inlet of the gun; a foraminous layer definesg a surface for supporting articles to be cleaned in a preferred orientation relative to the second outlet. The system includes additions spray nozzles for spraying the exterior of the articles being cleaned. In addition the system includes a bracket for orienting a paint can in a relatively rotational manner relative to a spray nozzle interior to the paint can for enhancing the cleaning thereof. A trigger lock is also provided to maintain the trigger mechanism of the spray gun in an activated condition.

6 Claims, 2 Drawing Sheets

FIG. 1
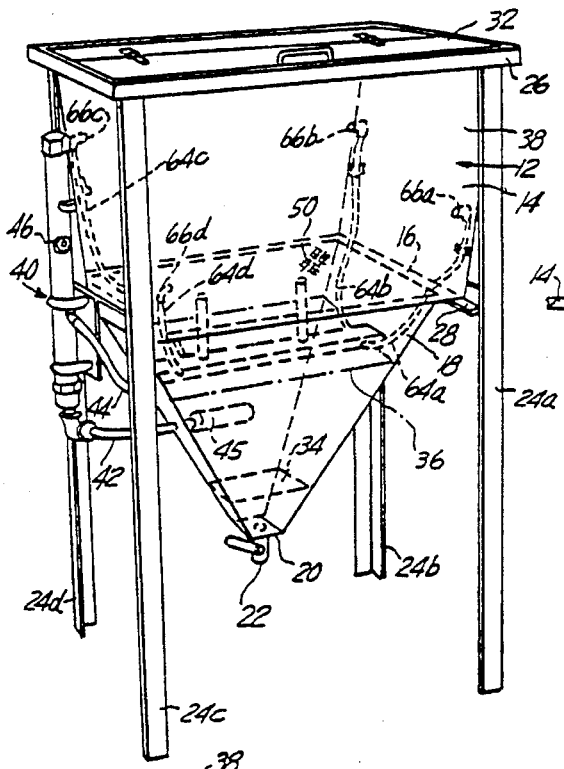
FIG. 3
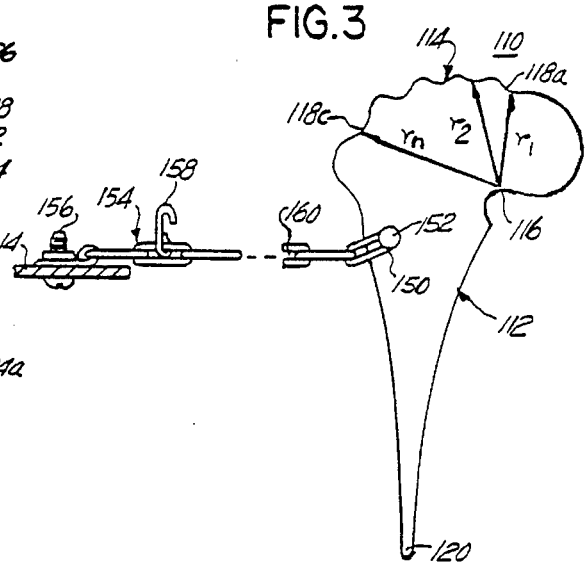
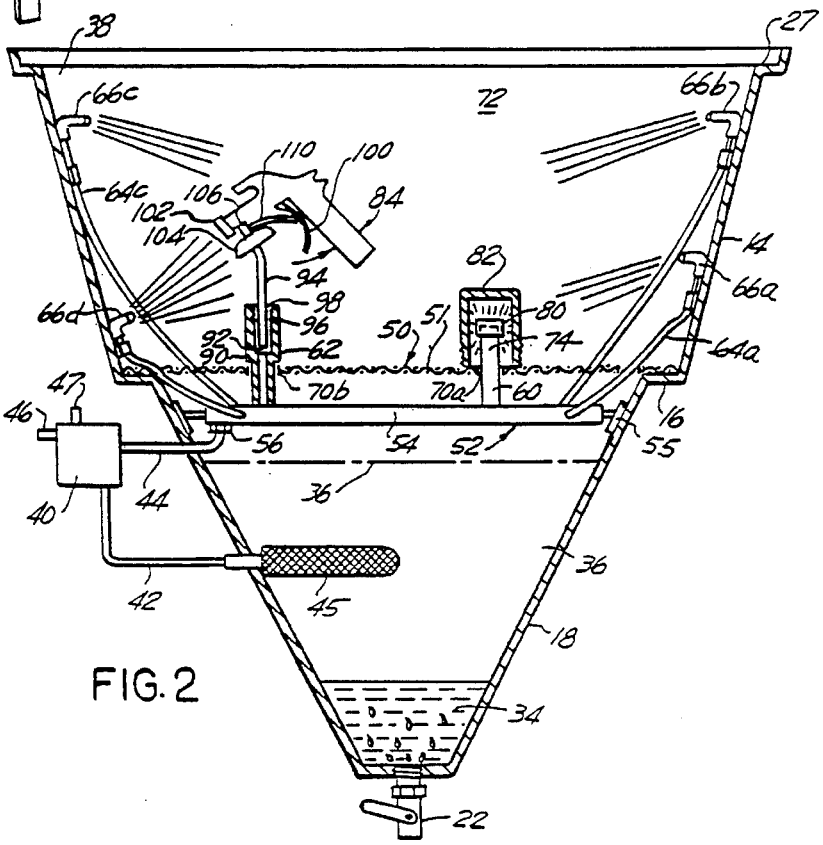
FIG. 2

SPRAY GUN AND ASSOCIATE PARTS WASHER AND RECYCLER

This application is a division of application Ser. No. 07/362,611 filed on Jun. 7, 1989, now U.S. Pat. No. 3,174,317, which is a Divisional application of Ser. No. 07/288,466 filed on Dec. 22, 1988, abandoned, which is a continuation application of Ser. No. 06/904,097 filed Sep. 5, 1986 now U.S. Pat. No. 4,793,369.

BACKGROUND AND SUMMARY OF THE INVENTION

The present invention relates to a system for automatically cleaning paint laden objects and more particularly to a system for cleaning spray guns, associated paint cups and paint cans.

Pneumatically operated paint spray guns have long been used in painting operations. The term spray guns, as used in a generic sense, typically includes a hand held spray gun and a can or cup, attached to the gun, for holding the paint to be sprayed. There are three varieties of spray guns commonly in use, two of which are of the bottom feed type in which paint is positioned below the nozzle of the gun. One such variety of bottom feed spray gun is a syphon type in which a cup, containing paint is directly fastened to the spray gun below its nozzle. In operation paint is communicated to the nozzle by vacuum action through a pick-up tube. Another type of bottom feed spray gun includes a spray gun communicated with a remotely located can of paint. This paint or mixing can is pressurized forcing paint through an inlet tube in the gun. The other variety of spray gun is the gravity feed type in which the cup, containing paint, is positioned above the nozzle and communicated thereto by the action of gravity.

After painting is completed a residue of paint is left in the cup, and within the various passages of the gun, i.e. its pick-up or inlet tube and nozzle, as well as on the exterior of the gun and cup. This residual paint must be removed before the gun and the cup can be used again. Further, with regard to a paint or mixing can it is desirable to clean same so that it can also be reused.

Prior to the present invention, the operator, upon completion of painting, would disconnected the cup from the gun and discard the excess paint from the cup. Thereafter, the operator would scrub and rinse the cup with paint solvent by hand. This procedure would be repeated until the cup was at least superficially cleaned. Paint or mixing cans would be cleaned in a similar manner or simply disposed. Alternatively, the operator may have immersed the cup, paint can and/or gun in a container of solvent for a period of time to remove the accumulated paint. In any event after the cup had been cleaned, the operator would then reconnect it to the gun and spray solvent, as opposed to paint, through the gun thereby cleaning the interior mechanisms of the gun. As can be seen these procedures are both costly, hazzardous to one's health and time consuming. These manual procedures have been somewhat improved by spray gun cleaners which still require the various parts of the gun and cup to be manually washed and then these superficially cleaned parts reassembled with clean solvent within the cup. The assembled spray gun is then inserted into a mechanism which holds the assembled spray gun in an activated condition. The assembled gun is rinsed by the clean solvent in the cup as it is drawn through the gun under the action of air which is also provided by the mechanism. In this manner the operator is not required to physically hold the gun as the solvent is sprayed therefrom and is free to pursue other tasks.

The present invention provides a means for automatically and thoroughly cleaning the gun and cup, and a paint can both internally and externally in a reliable, fast and inexpensive manner.

It is an object of the present invention to automatically clean the various components of a spray gun by introducing pressurized solvent through the inlet of the gun and within the cup while simultaneaously cleaning the exteriors thereof.

It is another object of the present invention to provide means for automatically cleaning and recycling a paint can.

It is a further object of the invention to provide a continuous source of clean solvent to the various components being cleaned.

A further object of the invention is to provide means for collecting the previously dried or liquid paint as it is removed from the components being cleaned and to collect same apart from the paint solvent and work chamber which houses the parts being cleaned.

A further object of the invention is to provide a cleaning system having three distinct portions: a solvent reservoir, a reservoir into which dislodged paint can accumulate and later be removed and a work chamber, remote from the other two portions into which the parts to be cleaned may be placed.

Accordingly, the invention comprises:

A paint removal system for cleaning paint from an object comprising an enclosed housing divided into a work chamber and a fluid storage reservoir containing paint solvent and a fluid, having a specific gravity greater than that of the solvent. The system further includes spray means including a first, second and other outlets adapted to receive pressurized solvent. The first outlet including means for receiving and supporting a spray gun and for directing solvent to flow through an inlet of the gun. The system additionally includes means defining a surface for supporting articles to be cleaned in a preferred orientation relative to the second outlet and means for recirculating solvent from the reservoir to the spray means.

The system includes additional spray nozzles for spraying the exterior or otherwise exposed surfaces of the articles being cleaned. In addition, the system includes a bracket for orienting a paint can in a relatively rotational manner relative to spray means, interior to the paint can, for enhancing the cleaning thereof. A trigger lock is also provided to maintain the trigger of the spray gun in an activated condition.

Many other objects and purposes of the invention will be clear from the following detailed description of the drawings.

BRIEF DESCRIPTION OF THE DRAWINGS

In the drawings:

FIG. 1 illustrates the preferred embodiment of a washing and recycling system constructed in accordance with the invention.

FIG. 2 is an isolated view of a housing and also illustrates many of the major components of the invention.

FIG. 3 is a plan view of a trigger lock.

DETAILED DESCRIPTION OF THE DRAWINGS

Figure 4:
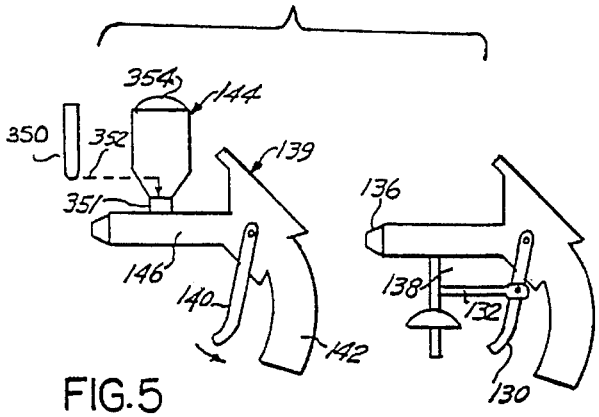
FIG. 4 illustrates various spray guns usable within the present invention.

Reference is now made to FIG. 1 which illustrates an orthogonal view of the present invention. More specifically there is shown a paint washing and recycling system 10 comprising a housing, generally designated as 12. The housing 12 includes a generally rectangular upper member 14. The member 14 terminates at a circumferential shoulder 16. Extending downwardly from the member 14 is a second or lower member 18 having a shape resembling that of a truncated, right rectangular cone. The member 18 terminates at a bottom 20. Extending from the bottom 18 is a drain valve 22. The housing 12 is supported by a plurality of supports or legs 24*a–d*, a top support 26 and a plurality of lateral supports 28 which engage the shoulder 16. The support 26 also serves to rigidify the housing 12, especially if a plastic housing is used. It should be noted that the front lateral support has been removed for clarity. Fitted to the top support 26 is a hinged cover 32 received within a ledge or shoulder 27 of the housing 12. A small amount of water, generally shown as 34, is placed within the lower portion of the member 18. Above the water is located a larger volume of paint solvent 36. The water and solvent are poured into the housing through its open end 38. The water 34 having a higher specific gravity than the paint solvent 36 will tend to the bottom of the member 18 where it and any dislodged paint can be periodically removed by opening the drain valve. Upon removal of the water 34 and dislodged paint additional water in then added to the solvent 36. Secured to the support 24*d* is a pump 40. While an air actuated, pulsating pump is shown it is not a requirement of the invention. The pump 40 includes an inlet 42 in communication with a filter 45 disposed in the solvent 36 and an outlet 44 situated above the solvent 36. The outlet 44 is connected to a manifold assembly 52, as more clearly shown in FIG. 2. The pump 40 further includes an air inlet 46 adapted to receive pressurized air from a compressor or the like.

Reference is now made to FIG. 2 which is a cross-sectional view of the housing and illustrates many of the major features of the present invention. FIG. 2 is an isolated view of the housing 12 and does not illustrate the support means or cover 32 shown is FIG. 1. Situated above the solvent 36 and supported upon the shoulder 16 is a wire mesh 50 or other suitable foraminous material. The mesh 50 divides the housing 12 into a work chamber 72, separate from the solvent 36 and water 34, into which parts to be cleaned may be placed and also defines a surface 51 for supporting such parts. Positioned below the mesh 50 is the manifold assembly 52, comprising a manifold 54, secured to the housing 12 by brackets 55 or other equivalent mounting means. The manifold assembly 52 further includes an inlet 56 adapted to communicate with the output 44 of the pump 40 and a plurality of outlets 60, 62 and 64 *a–d* also shown in FIG. 1. These outlets extend through openings 70 is the mesh 50 and into the working chamber 72 of the housing 12. More specifically, the manifold assembly outlets includes a first outlet 60 comprising a first tube 74 which extends through one of the openings 70*a*. Situated atop the tube 74 is a first spray head 80. A cup 82 of a spray gun 84 may be positioned on the mesh 50 in an inverted manner about the spray head 80 to receive of the solvent 36. Another manifold outlet such as outlet 62 comprising another tube 90 which includes a stepped bore 92 adapted to receive and support the spray gun 84. The spray gun 84 illustrated in FIG. 2 is of the syphon type and its inlet comprises a syphon tube 94 which is received and supported within the stepped bore 90. The tube 90 may further include threads 96 proximate its open end 98 for receiving an adaptor used in conjuction with the gravity type spray gun. Adaptors are discussed in greater detail below.

The syphon type spray gun 84 further includes a trigger 100, a nozzle 102, a cap 104, usually adapted to threadably engage matching threads of the cup 82 or is alternatively secured thereto by retaining clips, and an extension of the syphon tube generally shown as 106. As will be described in greater detail below, pressurized solvent is forced through the inlet 94 of the spray gun 84 from the tube 90. In order for this to occur, the trigger 100 must be positioned in its actuated position. This is accomplished by a trigger lock 110. The trigger lock 110 includes means for maintaining a variety of differently constructed trigger mechanisms in their respective actuated positions. The trigger lock 110 is shown in greater detail in FIG. 3. As an example, trigger mechanisms fall into the following general categories: a trigger 100 spaced from an extension tube 106, such as that illustrated in FIG. 2, a trigger 130 (shown is FIG. 4) having a moving piston 132 adapted to open and close an orifice leading to the spray nozzle 136. Typically a small, often substantially rectangular, opening 138 is formed by this trigger mechanism between the piston 132 and the surrounding parts of the spray gun. Another type of trigger mechanism, also shown in FIG. 4, is that employed within the gravity feed type of gun 139 and usually includes a trigger 140 movably situated relative to a gun handle 142.

The trigger lock 110 is designed to actuate each of the above described types of trigger mechanisms and comprises a substantially flat plate 112 having an enlarged end 114. The end 114 includes a first notch 116 adapted to engage the extension of the inlet tube 106 of a spray gun such as that illustrated in FIG. 2. The trigger lock 110 includes a plurality of trigger notches 118 which are spaced at varying radii r1, r2 etc. from the first notch 116 and which are adapted to receive and engage the trigger 100 of the gun. More specifically, after the trigger 100 is manually depressed and the first notch 116 is fitted to the inlet tube 106. The trigger lock 110 is rotated such that one of the trigger notches 118 fits securely against the depressed trigger 100 thereby keeping it in its actuated position. When used with the trigger mechanism illustrated by the gun on the right hand side of FIG. 4 the tapered end 120 of the trigger lock 110 is inserted into the space 138 (with the trigger 130 depressed) thereby similarly maintaining the trigger 130 in its actuated position. Returning briefly to FIG. 3 it can be seen that the trigger lock 110 further includes an opening 150 through which is received a fastener 152. The fastener 152 engages one end of a chain 154. The other end of the chain 154 is secured within the work chamber 72 by another fastener 156. Such securement may be to the housing 12, mesh 50 etc. The chain 154 includes a hook 158 which permits the chain 154 to be wrapped securely about the handle 142 and the depressed trigger 140 of a gravity type gun, and thereafter hooked into a cooperating opening 160 within the chain 154 forming a loop thereby securing this type of trigger mechanism in its actuated position.

Returning to FIGS. 1 and 2, as previously mentioned the manifold assembly 52 further includes additional outlets 64 *a–d*. In the preferred embodiment of the invention these additional outlets comprise of tubing extending from the manifold 54 into the work chamber 72. These outlets 64 extend from the manifold 54 and are located proximate the inner corners of the upper member 14. Fitted to each of these outlets 64 is a spray nozzle 66 which are oriented to spray solvent upon the exposed portions of a gun, such as the gun 84 and a cup, such as cup 82, thereby providing a source of solvent to clean the exposed surfaces of these parts.

Reference is again made to FIG. 4 which illustrates the gravity feed type of spray gun 139. As illustrated therein, this type of gun includes a cup 144 which is threadably received onto the stock 146 of the gun 139. As previously mentioned, this type of gun can also be cleaned by the system 10 and requires an adaptor 350, such adaptor 350 also being shown in FIG. 4. In operation the cup 144 is removed and the adaptor 350 inserted therefor at a paint inlet 351 as shown by the arrow 352. The adaptor 350 may be threadably received, or press fit or loosely received into the inlet 351. Occasionally, the inlet 351 of other types of gravity feed guns 139 is positioned differently from the vertical orientation shown in FIG. 4. Some guns use a horizontal attachment. If this is the case, the gun will be received into the tube 90 in a half-turned or otherwise rotated condition. The adaptor 350 is thereafter inserted into, or alternatively over or onto a tube such as the tube 90 with the gun 139 is an inverted or rotated position. Similarly, the cup 144 which usually includes a removable top portion 354, is disassembled and placed over the other outlet 60, tube 74 and spray nozzle 80.

Figure 4A:
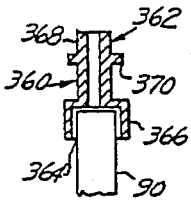
FIG. 4*a* illustrates an alternative embodiment of an adaptor shown in FIG. 4.

FIG. 4*a* illustrates an alternate embodiment of the adaptor 350. This alternate adaptor 360 comprises a hollow fitting 362 having an end 366 including an opening 364 for receiving an end of a tube such as tube 90. The other end 368 of the fitting 362 is adapted to be inserted into the paint inlet 351 of the gun 139. A shoulder 370 may be provided to support the gun 139 thereon in its mounted orientation. It can be appreciated that the end 366 of the fitting 362 may be shaped differently than shown in FIG. 4*a* for receiving the tube 90 and may very according to and conform with the shape of the tube 90.

Figure 5A:
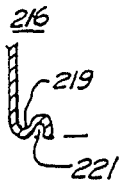
FIG. 5*a* is an exploded partial view of a rim of a typical paint can.
Figure 5:
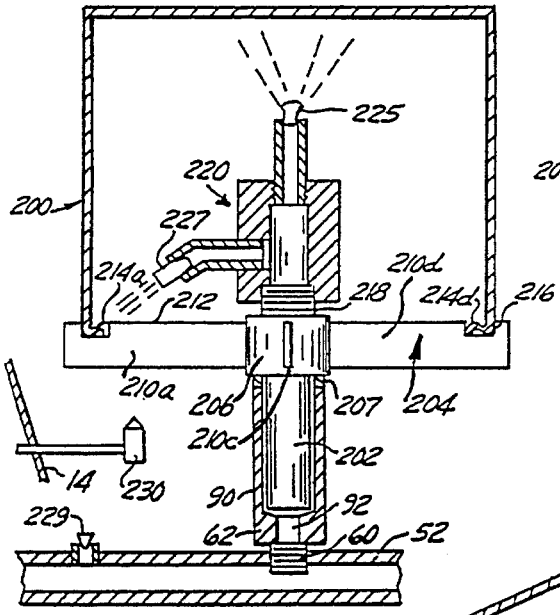
FIGS. 5, 6, and 7 illustrate various means for holding and cleaning a paint can for use within the system.
Figure 6:
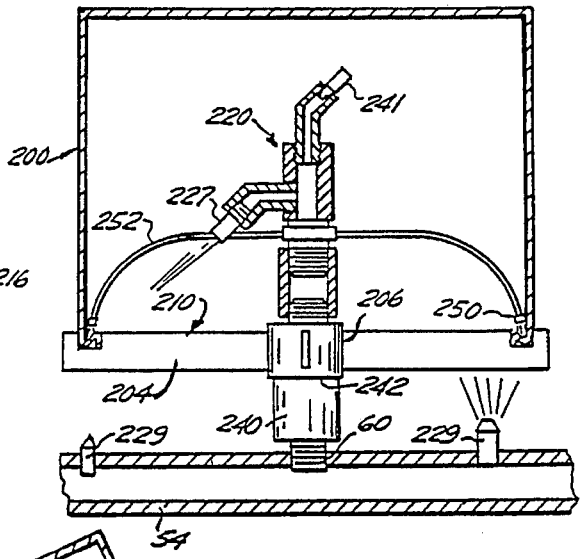

Reference is now made to FIGS. 5 and 6 which illustrate alternate embodiments of the invention. More specifically, these FIGUREs illustrate means for cleaning a paint can 200. FIG. 5 is a partial section of the manifold assembly 52 and shows the outlet 62 and stepped tube 90. Received within the tube 90 is a hollow tube or pipe 202. The tube 202 is received within a hollow cylindrical member 206 of a bracket 204 adapted to secure thereto the paint can 200. The bracket 204 includes a plurality of narrow wings or supports 210 *a–d* radially extending from the cylindrical member 206. The upper surface 212 of each of these supports includes a groove 214 *a–d* for receiving and securing the rim 216 of the paint can 200. Typically, the rim 216 of paint cans comprise an inner lip 219 and an outer lip 221 shown in greater detail in the exploded partial section of FIG. 5*a*. Threadably received upon one end 218 of the tube 202 is a spray nozzle 220 which sprays pressurized solvent throughout the interior of the paint can 200. The spray nozzle 220 includes a vertical spray head 225 having a preferrably, relatively broad spray pattern. The nozzle 220 further includes another spray head 227 having a narrow or jet spray pattern directed at the inner lip 219 for removing paint therefrom. In order to enhance the cleaning of paint from the outer lip 221 the manifold 52 may be provided with additional outlets or spray heads 229 having a concentrated spray or jet-like pattern directed at the outer rim 221. It is desirable that a relative motion be created between the paint can 200 and the spray nozzle 220. This can be achieved be keeping the supports 210 relatively stationary and permitting the nozzle to rotate relative to the end 218 of the tube 202. Such rotation being achieved as a reaction to the pressurized solvent exiting the nozzle 220 similar to the action achieved by a lawn sprinkler. Alternatively, the spray nozzle 220 can be fixedly attached to the tube 202 and the supports made to rotate relative to the nozzle 220 about the tube 202. This can be achieved by loosely securing the member 206 about the tube 202 such that the member 206 functions as a bushing and permits rotation about the end of the inlet tube 90. If needed a separate bushing 207 can be inserted between the member 206 and the tube 90. Positioned below and remote from the supports 210 is a fluid nozzle 230 Such nozzle may be cantilevered from the upper housing member 14 or directly connected to the manifold 54. This nozzle 230 is communicated to a source of pressurized fluid such the outlet 47 of the pump 40. Such outlet 47 being shown in FIG. 2. In response to the force of the pressurized fluid against the supports 210 the bracket 204 is caused to turn, about the tube 202, relative to the stationary spray nozzle 220. The outlet 47 may provide pressurized air or alternatively pressurized solvent to cause the bracket 204 to rotate.

FIG. 6 illustrates various alternate embodiments of the paint can cleaning mechanism of FIG. 5. There is illustrated a tapered adaptor 240 received within the outlet 60 in communication with the manifold 54. The adaptor defines a shoulder 242 about which is received the bracket 204. The bracket 204 includes the central member 206 which is loosely received thereabout. In this manner the member 206 functions as a bushing, as previously described, permitting the bracket to revolve about the adaptor 240 under the action of pressurized fluid which is communicated thereto. Attached to the adaptor 240 is the spray nozzle 220 having an angled spray head 241 which generates a relatively broad spray pattern. Alternatively, the bracket 204 can be fixedly attached to the adaptor 240, however, the nozzle 220 must be rotatingly attached to the end of the adaptor 240. In this case, pressurized fluid need not be communicate to the bracket 204.

FIG. 6 illustrates a further embodiment of the invention. A brush or brushes 250 are flexibly supported relative to the paint can 200 by a flexible rod 252. The brush or brushes 250 are urged into the inner lip 219 of the rim 216 by the spring force generated by the flexible rod 252. The brush or brushes 250 may be supported in a relatively non-rotational manner by the adaptor 240 and sweep, brush or otherwise remove solvent and paint from the lip 219 as it rotates thereunder. Alternatively, the brushes may be suspended from a rotating nozzle, as such, the brushes will clean the rim of the paint can as they rotate thereby. In addition, it should be appreciated that the bias force urging the brushes into the rim 216 lightly biases the paint can 200 onto the bracket 204 thereby assisting in its securement thereto. The precise number and orientation of the brushes may vary as the need requires.

Figure 7:
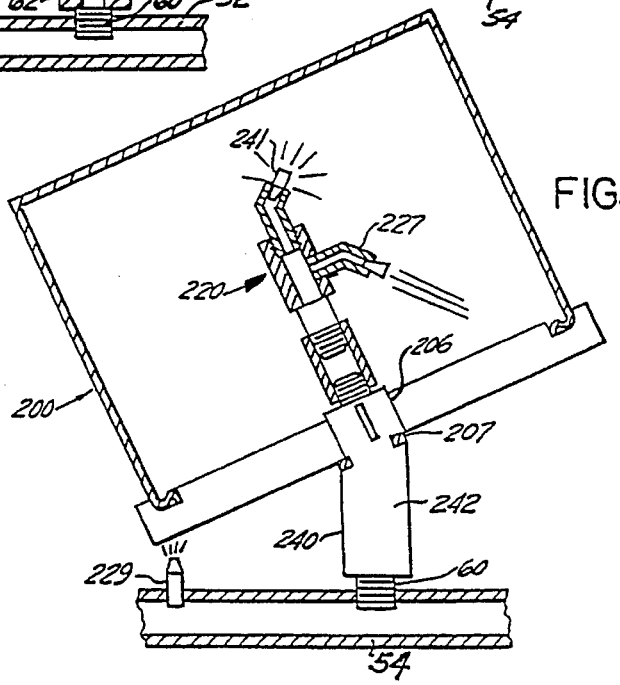

Reference is now made to FIG. 7 which illustrates still another embodiment of the invention. In this embodiment of the invention the supports 210, previously shown in FIGS. 5 and 6, are maintained at an angle relative to vertical. In this manner as the paint can 200 is rotated in reaction to the pressurized fluid, or alternatively as the nozzle 220 rotates, any solvent and/or dislodged paint which may have accumulated within the rim 216 of the paint can 200 is caused to slosh about the can 200 and caused to fall out through the open end thereof proximate the lower portions of the rim. It can be appreciated that a stationary spray nozzle, such as the spray nozzle 227 is preferrably directed toward that portion of the rim 216 which is elevated.

Many changes and modifications in the above described embodiment of the invention can, of course, be carried out without departing from the scope thereof. Accordingly, that scope is intended to be limited only by the scope of the appended claims.

We claim:

1. In a paint removal system which includes a housing within which a paint gun is temporally held for removing paint from the paint gun, which paint gun has an outwardly extending paint supply tube through which paint normally flows into the gun for painting, the improvement comprising:

a support member arranged within the housing and having an end portion which is temporarily connectable to, for holding a free, open lower end of the paint supply tube so that the paint gun is substantially supported upon the support member by its paint supply tube;

the support member having a passageway extending through it and through which solvent is flowed;

the support member passageway communicating with the open, lower end of the paint supply tube for flowing solvent through the tube and, therefore, through the gun;

whereby the support member delivers solvent to the gun, while holding the gun, so that no additional support means is needed for holding the gun in its supported position during the passage of the solvent through the gun for cleaning the gun.

2. In a paint removal system which includes a housing within which a paint gun is temporality held for removing paint from the paint gun, which gun has a paint inlet through which paint is normally flowed into the gun when the gun is used for painting, the improvement comprising:

a support member located within the housing and having a portion formed for connecting with the gun paint inlet for, thereby, holding the gun upon the support member;

the support member having a passageway extending therethrough for flowing solvent through the support member to a fluid outlet in the support member;

the support member fluid passageway communicating with the paint inlet formed in the gun for flowing solvent through the paint inlet and the gun for cleaning purposes;

whereby the support member delivers the solvent to and through the gun while simultaneously holding the gun in a supported position within the housing during cleaning of the gun by the passage of the solvent therethrough.

3. A paint removal system for cleaning paint from an object comprising:

an enclosed housing divided so that a portion thereof forms a work chamber;

spray means including a first and a second outlet adapted to receive pressurized solvent;

said first outlet including means for loosely receiving a spray gun and providing the primary support for the spray gun and for directing solvent to flow into the spray gun being devoid of any coupling for fixedly holding the spray gun thereto;

means defining a surface for supporting various articles of differing configuration to be cleaned, including paint cups and paint cans, in a preferred orientation relative to said second outlet;

means for recirculating solvent from a reservoir to said spray means, wherein said recirculating means includes a pulsating pump for causing the solvent to be sprayed from various of said outlets in a pulsating manner.

4. A paint removal system for cleaning paint from an object comprising:

a housing divided so that a portion thereof forms a work chamber;

fluid means including at least a first outlet adapted to receive pressurized cleaning agent;

said first outlet including means for supporting a spray gun, the supporting means being of various diameters allowing a spray gun inlet to fit securely enough thereon to allow cleaning agent to flow into the spray gun and to provide the primary support for the spray gun;

means for recirculating cleaning agent from a reservoir to said fluid means including means for positively pressurizing said cleaning agent supplied to said fluid means.

5. A paint removal system for cleaning paint from an object comprising:

an enclosed housing divided so that a portion thereof forms a work chamber;

spray means including a first and a second outlet adapted to receive pressurized solvent;

said first outlet including means for receiving and supporting a spray gun and for directing solvent to flow into said spray gun;

means defining a surface for nonfixedly supporting an article to be cleaned in a preferred orientation relative to said second outlet;

means for recirculating solvent from a reservoir to said spray means, wherein said recirculating means includes a pulsating pump for causing the solvent to be sprayed from various of said outlets in a pulsating manner.

6. A paint removal system for cleaning paint from an object comprising:

a housing divided so that a portion thereof forms a work chamber;

fluid means including at least a first outlet adapted to receive pressurized cleaning agent;

said first outlet including means for loosely supporting a spray gun, such supporting means including means for directing cleaning agent to flow through the spray gun including a fluid receiving passage having a stepped portion, wherein the inlet of the spray gun is supported upon the stepped portion;

means for recirculating cleaning agent from a reservoir to said fluid means including means for positively pressurizing said cleaning agent supplied to said fluid means.

* * * * *